US008238732B2

(12) United States Patent
Kao et al.

(10) Patent No.: US 8,238,732 B2
(45) Date of Patent: Aug. 7, 2012

(54) OVEN WITH LIGHT EMITTING DIODE AND/OR LASER DIODE AS HEATING DEVICES

(75) Inventors: Fu-Jen Kao, Taipei (TW); Yi-Cheng Lin, Taipei (TW)

(73) Assignee: National Yang-Ming University, Taipei (TW)

( * ) Notice: Subject to any disclaimer, the term of this patent is extended or adjusted under 35 U.S.C. 154(b) by 628 days.

(21) Appl. No.: 12/411,051

(22) Filed: Mar. 25, 2009

(65) Prior Publication Data

US 2009/0245762 A1 Oct. 1, 2009

(30) Foreign Application Priority Data

Mar. 25, 2008 (TW) ..... 97110306 A

(51) Int. Cl.
*A21B 2/00* (2006.01)

(52) U.S. Cl. ..... 392/416; 392/407; 219/391

(58) Field of Classification Search ..... None
See application file for complete search history.

(56) References Cited

U.S. PATENT DOCUMENTS

| | | | | |
|---|---|---|---|---|
| 4,496,827 | A * | 1/1985 | Sturdevant | 219/399 |
| 6,818,864 | B2 * | 11/2004 | Ptak | 219/390 |
| 7,474,842 | B2 * | 1/2009 | Bergstein | 392/379 |
| 7,921,768 | B2 * | 4/2011 | Fernandez et al. | 99/419 |
| 2004/0104220 | A1 * | 6/2004 | Ryu | 219/685 |

FOREIGN PATENT DOCUMENTS

JP 2002147762 A 5/2002

* cited by examiner

*Primary Examiner* — Thor Campbell
(74) *Attorney, Agent, or Firm* — WPAT, P.C.; Anthony King

(57) ABSTRACT

The present invention provides an oven that utilizes light emitting diode (LED) and or laser diode (LD) as heating devices. Such heating devices will enable a wide variety of heating modalities.

8 Claims, 4 Drawing Sheets

(A)

(B)

(A)

(B)

OVEN WITH LIGHT EMITTING DIODE AND/OR LASER DIODE AS HEATING DEVICES

FIELD OF THE INVENTION

The present invention provides an oven that utilizes light emitting diode (LED) and/or laser diode (LD) as heating devices. Such heating devices will enable a wide variety of heating modalities.

BACKGROUND OF THE INVENTION

An oven and a toaster are an apparatus that heats up food or materials placed inside a closed or semi-closed structure. Heating with hot air is generally referred as roasting. Generally speaking, these devices perform high-temperature processing on food and materials.

The working principle of modern electric oven is to use current heating tubes (that is based Ohm's heating) to heat up the inner air and food. In the older oven, quartz tube is adopted; in the newer one, copper tube is used. In general, two copper tubes are set at the top and bottom sides of the oven. For ovens with ultra larger volume, a W-shaped tube is adopted for increasing the length of the heating tube and for enhancing the heating efficiency. Usually there is only one heating power level for such an appliance. The heating tube has only one power rating. When the desired temperature is reached in the oven, the heating tube is turned off; when the temperature in the oven drops down, the heating tube is turned on again. Thereby, the temperature in the oven is controlled at a fixed temperature through a thermostat.

The heating source of current commercial toaster oven usually suffers from low radiation energy conversion efficiency and nonuniform heating. In addition, there is no design for varying the heating pattern. Thereby, the present invention provides an oven to address the above issues. According to the Japan Patent Publication Number 2002-147762, a food cooker using laser as heating source is provided. However, it still cannot achieve partial heating as precisely as can be done by the oven provided according to the present invention.

SUMMARY OF THE INVENTION

The present invention provides an oven with multimodality heating, comprising:

a container, used as the case of the oven;

a movable plate, set on the inner wall of the container, and movable along the inner wall of the container; and a heating source, composed of a plurality of point heating sources, set on the movable plate, the heating direction facing the interior of the container, and the heating status of each of the point heating sources being controlled according to setups of a user, respectively, for providing various heating modes.

The present invention further provides an oven with a diode, comprising:

a container, used as the case of the oven;

a diode, set inside the container, and used for emitting heat for heating a target; and a light reflector, set at a place capable of reflecting the light inside the container for reflecting the light emitted by the diode and for enhancing the heating efficiency on the target.

DETAILED DESCRIPTION OF THE INVENTION

Figure 1:
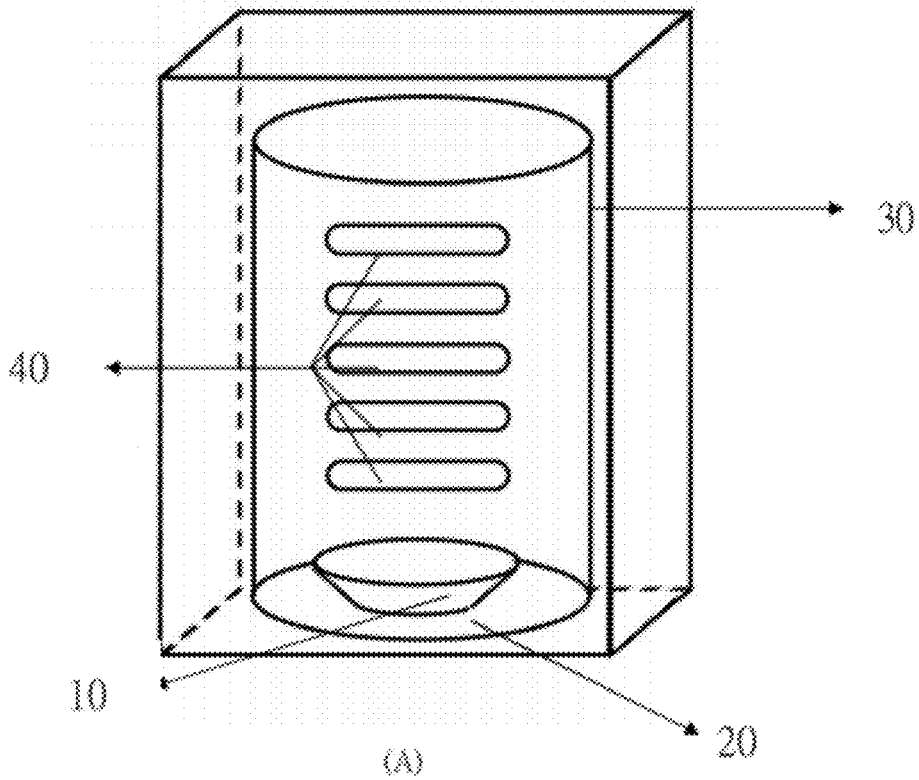
FIG. 1A shows a front perspective view of an oven using laser diodes as the heating sources which according to a preferred embodiment of the present invention.
FIG. 1B shows a top perspective view of an oven using laser diodes as the heating sources according to a preferred embodiment of the present invention.
Figure 1:
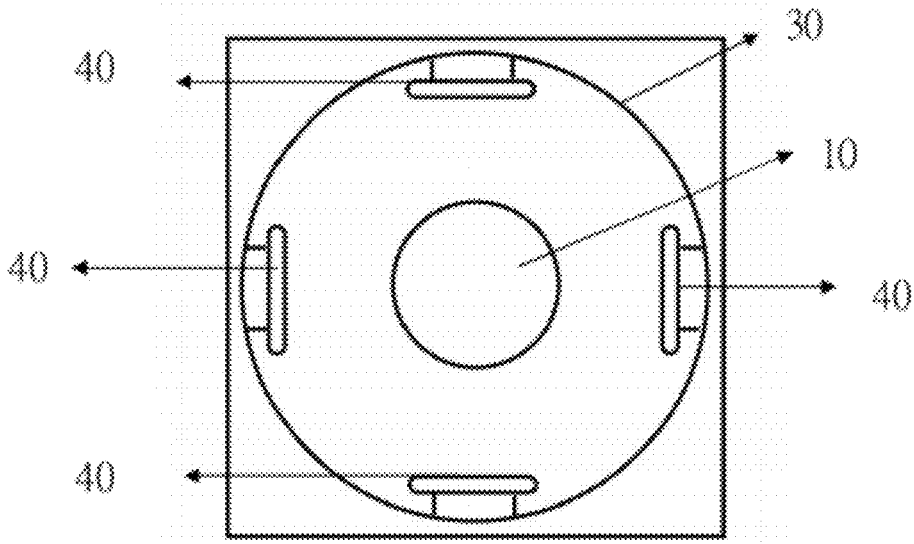

In order to make the structure and characteristics as well as the effectiveness of the present invention to be further understood and recognized, the detailed description of the present invention is provided as follows along with preferred embodiments and accompanying figures.

According to the present invention, the drawbacks of conventional ovens involved in the prior art, which include very simple heating modes, low radiation energy conversion efficiency, and nonuniform heating, are improved. According to the prior art, the heating sources are nothing more than gas, infrared, or microwave. However, these heating sources usually have the drawbacks described above. Therefore, according to the present invention, diodes are adopted to provide heat. Based on optoelectronic principles and the characteristics of diodes, which include transient behavior for providing pulsed light, the oven according to the present invention has the advantages of environment friendliness, small volume, uniform heating, long lifetime, partial heating, and multiple heating modes.

The present invention provides an oven with multimodality heating, which comprises:

(a) a container, used as the case of the oven;

(b) a movable plate, set on the inner wall of the container, and movable along the inner wall of the container; and (c) a heating source, composed of a plurality of point heating sources, set on the movable plate, the heating direction facing the interior of the container, and the heating status of each of the point heating sources being controlled according to setups of a user, respectively, for providing various heating modes.

According to a preferred embodiment of the present invention, the point heating sources in the oven with multimodality heating are laser diodes (LDs) or light-emitting diodes (LEDs). A light reflector is further included. The light reflector is set at a place capable of reflecting the heating sources inside the container for reflecting the heating sources and for enhancing the heating efficiency on the target. Besides, the oven with multimodality heating according to the present invention is preferable for heating food, chemical substances, and medicines.

The present invention further provides an oven with a diode, which comprises:

(a) a container, used as the case of the oven;

(b) a diode, set inside the container, and used for emitting heat for heating a target; and (c) a light reflector, set at a place capable of reflecting the light inside the container for reflecting the light emitted by the diode and for enhancing the heating efficiency on the target.

According to a preferred embodiment of the present invention, the point heating sources in the oven based on diode are laser diodes (LDs) or light-emitting diodes (LEDs). The light reflector is a cylindrical polished stainless steel plate or a rotatable cylindrical polished stainless steel plate, and is placed inside the container. The target is placed at the center of the light reflector. According to a preferred embodiment, the LD is a 1200-Watt high-power laser diode bar; the LED is a 5-Watt high-power LED. In addition, the LED is attached to a plate, which is, in turn, attached to the light reflector, and is movable along the light reflector for changing the heating regions.

According to a preferred embodiment, the oven with a diode according to the present invention further comprises a revolving spindle 20 and a tray 10. The tray 10 is set on the revolving spindle 20, and is used for placing the target. The tray 10 is rotatable in order to heat the target uniformly. In a preferred embodiment, cylindrical polished stainless steel plate is also rotatable. In addition, the oven with a diode is preferable for heating food, chemical substances, and medicines. The more preferable embodiment of the present invention is heating evenly. The most preferable embodiment of the present invention is cost down owing to less diode required.

The examples below are non-limiting and are merely representative of various aspects and features of the present invention.

EXAMPLES

The devices applied in the present invention were introduced as follows:

1. High-power LED:

A high-power LED was an LED with power rating, which was the driving current times the voltage (P=IV), greater than 1 Watt. It had focus, high power, and transient characteristics.

2. Laser diode (LD):

A laser diode emitted light using stimulated emission. It had focus, high power, and transient characteristics.

3. High-power laser diode bar:

High-power laser diode bars used bars with approximately 500 μm in width to manufacture multi-mode laser chips, or used multi-stripes to form a laser array for providing light sources with even higher power.

4. Heat-resistant reflective material (for example, stainless steel or aluminum):

Some materials could be polished uniformly and brightly in the inner walls. Thereby, dirt and rust would not exist. Polishing could increase the reflectivity and hence enhancing heating efficiency. Besides, careful selection and processes of the materials could also improve heat-resistance.

In the following, the structure and method according to the present invention was described.

1. Laser diode (LD) oven:

The LD oven according to the present invention used high-power LD bars 40 set on the cylindrical polished stainless steel plate (a kind of heat-resistant reflective materials. Here, a polished stainless steel plate was adopted.) The LD oven adopted a plurality of 1200-Watt high-power LD bars 40. The polished stainless steel plate 30 was used to reflect light emitted by the LD bars 40. By taking advantage of mechanism design, light was focused on the target to achieve excellent heating efficiency. (FIG. 1)

a. Structure

The LD bars 40 were set at the inner side of the cylindrical polished stainless steel plate 30. The quantity of the LD bars 40 was determined according to the design of light intensity for the oven. The stainless steel was a heat-resistant material with high reflectivity. The target was heated by light emitted by the high-power LD bars 40 and by repeated reflection of the light in the cylindrical polished stainless steel plate 30. A revolving spindle 20 was set at the bottom with a tray 10 thereon. A square-shaped case covered the whole cylindrical stainless steel plate 30.

b. Operation Method

The target was placed on the tray 10. When the high-power LD bars 40 started to heat, the revolving spindle 20 started to rotate as well, and the target would rotate accordingly. The target was heated by light emitted by the high-power LD bars 40 and by repeated reflection of the light in the cylindrical polished stainless steel plate 30. The rotation of the tray 10 made heating even more uniform.

2. Light-emitting diode (LED) oven

Figure 2:
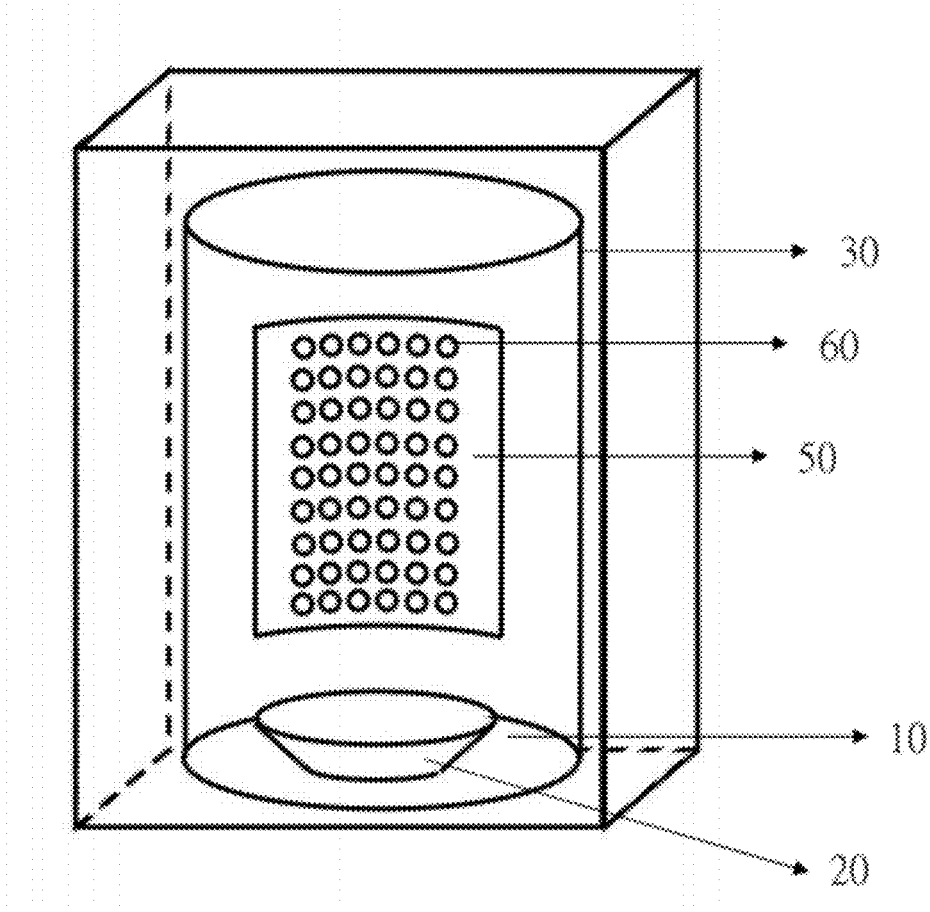
FIG. 2A shows a front perspective view of an oven using light-emitting diodes as the heating sources according to a preferred embodiment of the present invention.
FIG. 2B shows a top perspective view of an oven using light-emitting diodes as the heating sources according to a preferred embodiment of the present invention.
Figure 2:
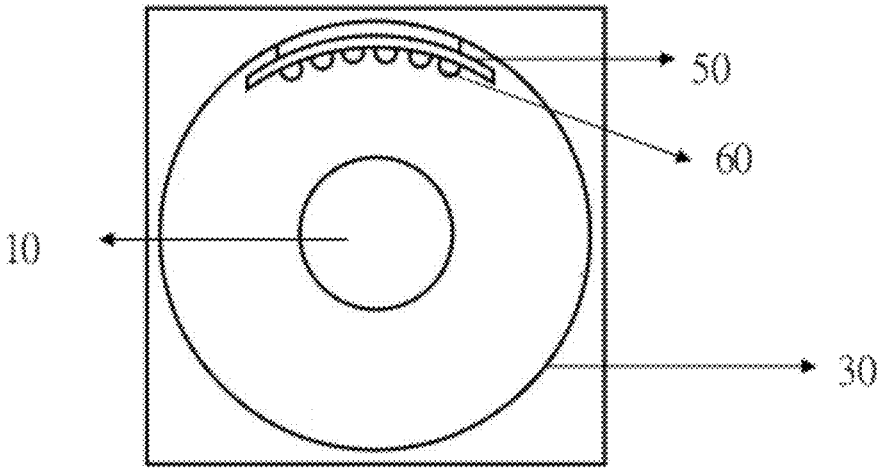

The LED oven used a movable high-power LED plate 50 set on the cylindrical polished stainless steel plate (a kind of heat-resistant reflective materials. Here, a polished stainless steel plate was used as an example). A plurality of high-power LEDs 60 was set on the movable high-power LED plate 50. The LED oven used multiple 5-Watt high-power LEDs 60. By means of movement of the movable high-power LED plate 50, reflection of the light emitted by the high-power LEDs 60, and mechanism design, the light was focused on the target and hence achieving excellent heating efficiency. In addition, because of the mechanism design and the characteristics of high-power LEDs 60, advanced functions such as partial heating on the target could be achieved as well. (FIG. 2)

a. Structure

A high-power LED plate 50 with a plurality of 5-Watt high-power LEDs 60 was set inside the cylindrical polished stainless steel plate 30. The stainless steel was heat-resistant with high reflectivity. The high-power LED plate 50 was movable along the inner wall to make heating mode varied (for example, partial heating). The target was heated by light emitted by the high-power LED plate 50 and by repeated reflection of the light in the cylindrical polished stainless steel plate 30. A revolving spindle 20 was set at the bottom with a tray 10 thereon. A case covered the whole cylindrical stainless steel plate 30.

b. Operation Method

The target was place on the tray 10. If uniform heating was desired, the high-power LEDs 60 were turned on and the high-power LED plate 50 started to rotate along the wall of the stainless steel plate. The revolving spindle 20 also started to rotate, and the height thereof could be adjusted for changing the position of the target. The target was heated by light emitted by the high-power LEDs 60 and by repeated reflection of the light in the cylindrical polished stainless steel plate 30. The rotation of the tray 10 made heating even more uniform.

If partial heating was desired, a heating option system of the oven was used. By means of the control system, the high-power LED plate 50 was moved to the place to be heated. Beside, by taking advantage of the characteristic of producing pulsed light by the high-power LEDs 60, heating regions and time could be controlled for performing the desired heating mode.

Figure 3:
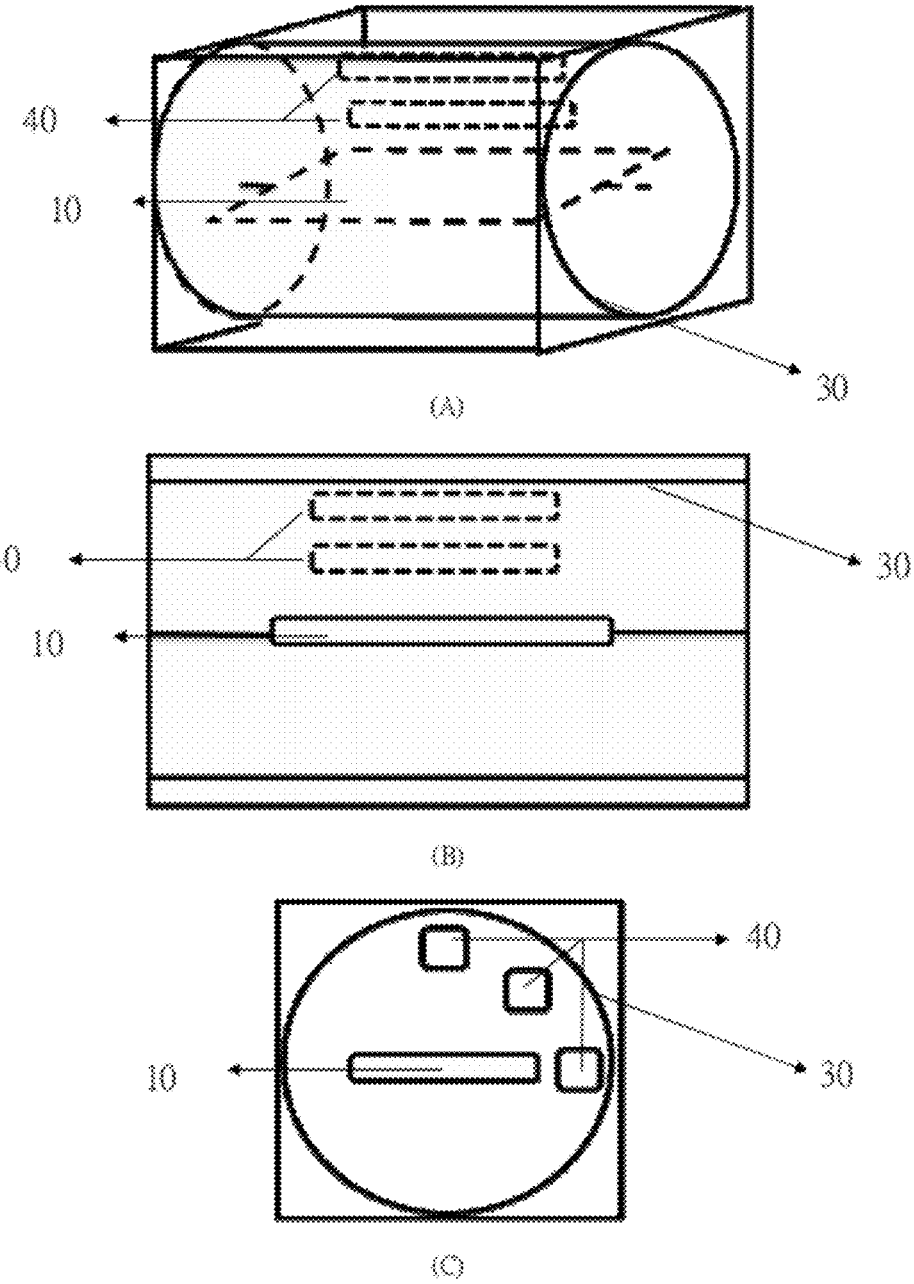
FIG. 3A shows a front oblique perspective view of a horizontal drum type oven using laser diodes as the heating sources which according to a preferred embodiment of the present invention.
FIG. 3B shows a front perspective view of a horizontal drum type oven using laser diodes as the heating sources according to a preferred embodiment of the present invention.
FIG. 3C shows a side perspective view of a horizontal drum type oven using laser diodes as the heating sources according to a preferred embodiment of the present invention.

3. Horizontal drum type laser diode (LD) oven:

The horizontal drum type LD oven according to the present invention used high-power LD bars 40 set on the rotatable cylindrical polished stainless steel plate (a kind of heat-resistant reflective materials. Here, a polished stainless steel plate was adopted.) The LD oven adopted a plurality of 1200-Watt high-power LD bars 40. The polished stainless steel plate 30 was used to reflect light emitted by the LD bars 40. By taking advantage of mechanism design, light was focused on the target to achieve excellent heating efficiency. (FIG. 3)

a. Structure

The LD bars 40 were set at the inner side of the rotatable cylindrical polished stainless steel plate 30. The quantity of the LD bars 40 was determined according to the design of light intensity for the oven. The rotatable stainless steel was a heat-resistant material with high reflectivity. The target was heated by light emitted by the high-power LD bars 40 and by repeated reflection of the light in the rotatable cylindrical polished stainless steel plate 30. A revolving spindle 20 was set at the bottom with a tray 10 thereon. A square-shaped case covered the whole rotatable cylindrical stainless steel plate 30.

b. Operation Method

The target was placed on the tray 10. When the high-power LD bars 40 started to heat, the rotatable cylindrical stainless steel plate 30 started to rotate. The target was heated by light emitted by the high-power LD bars 40 and by repeated reflection of the light in the rotatable cylindrical polished stainless steel plate 30. The rotation of the plate 30 made heating even more uniform.

4. Horizontal drum type light-emitting diode (LED) oven

Figure 4:
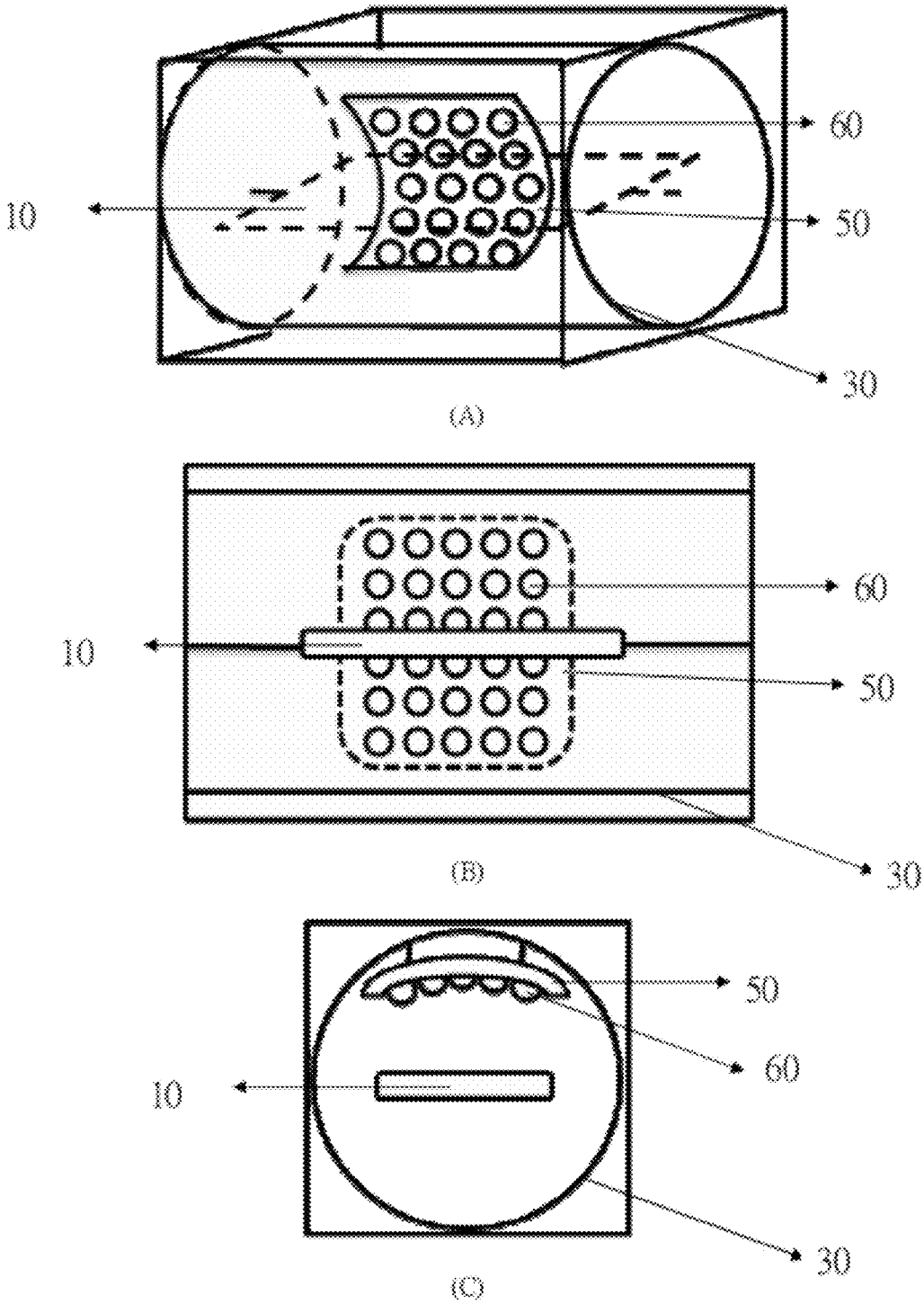
FIG. 4A shows a front oblique perspective view of a horizontal drum type oven using light-emitting diodes as the heating sources according to a preferred embodiment of the present invention.
FIG. 4B shows a front perspective view of a horizontal drum type oven using light-emitting diodes as the heating sources according to a preferred embodiment of the present invention.
FIG. 4C shows a side perspective view of a horizontal drum type oven using light-emitting diodes as the heating sources according to a preferred embodiment of the present invention.

The horizontal drum type LED oven used a movable high-power LED plate 50 set on the rotatable cylindrical polished stainless steel plate (a kind of heat-resistant reflective materials. Here, a polished stainless steel plate was used as an example). A plurality of high-power LEDs 60 was set on the movable high-power LED plate 50. The LED oven used multiple 5-Watt high-power LEDs 60. By means of movement of the movable high-power LED plate 50, reflection of the light emitted by the high-power LEDs 60, and mechanism design, the light was focused on the target and hence achieving excellent heating efficiency. In addition, because of the mechanism design and the characteristics of high-power LEDs 60, advanced functions such as partial heating on the target could be achieved as well. (FIG. 4)

a. Structure

A high-power LED plate 50 with a plurality of 5-Watt high-power LEDs 60 was set inside the rotatable cylindrical polished stainless steel plate 30. The stainless steel was heat-resistant with high reflectivity. The high-power LED plate 50 was movable along the inner wall to make heating mode varied (for example, partial heating). The target was heated by light emitted by the high-power LED plate 50 and by repeated reflection of the light in the rotatable cylindrical polished stainless steel plate 30. A case covered the whole cylindrical stainless steel plate 30.

b. Operation Method

The target was place on the tray 10. If uniform heating was desired, the high-power LEDs 60 were turned on and the high-power LED plate 50 started to rotate along the wall of the stainless steel plate. The rotatable cylindrical stainless steel plate 30 started to rotate, and the location thereof could be adjusted for changing the position of the target. The target was heated by light emitted by the high-power LEDs 60 and by repeated reflection of the light in the rotatable cylindrical polished stainless steel plate 30. The rotation of the plate 30 made heating even more uniform.

If partial heating was desired, a heating option system of the oven was used. By means of the control system, the high-power LED plate 50 was moved to the place to be heated. Beside, by taking advantage of the characteristic of producing pulsed light by the high-power LEDs 60, heating regions and time could be controlled for performing the desired heating mode.

Accordingly, the present invention conformed to the legal requirements owing to its novelty, non-obviousness, and utility However, the foregoing description was only a preferred embodiment of the present invention, not used to limit the scope and range of the present invention. Those equivalents changed or modifications made according to the shape, structure, feature, or functioning principle described in the claims of the present invention were included in the appended claims of the present invention.

One skilled in the art readily appreciates that the present invention is well adapted to carry out the objects and obtain the ends and advantages mentioned, as well as those inherent therein. The cell lines, animals, and processes and methods for producing them are representative of preferred embodiments, are exemplary, and are not intended as limitations on the scope of the invention. Modifications therein and other uses will occur to those skilled in the art. These modifications are encompassed within the spirit of the invention and are defined by the scope of the claims.

It will be readily apparent to a person skilled in the art that varying substitutions and modifications may be made to the invention disclosed herein without departing from the scope and spirit of the invention.

All patents and publications mentioned in the specification are indicative of the levels of those of ordinary skill in the art to which the invention pertains. All patents and publications are herein incorporated by reference to the same extent as if each individual publication was specifically and individually indicated to be incorporated by reference.

The invention illustratively described herein suitably may be practiced in the absence of any element or elements, limitation or limitations, which are not specifically disclosed herein. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

The invention claimed is:

1. An oven with a diode, comprising:

(a) a container, used as the case of the oven;

(b) a diode, set inside the container, and used for emitting heat for heating a target; and (c) a light reflector, set at a place capable of reflecting the light inside the container for reflecting the light emitted by the diode and for enhancing the heating efficiency on the target;

wherein the oven further comprises a revolving spindle; and a tray, which sets on the revolving spindle, uses for placing the target, and is rotatable for heating the target uniformly.

2. The oven of claim 1, wherein the diode is a laser diode (LD) or a light-emitting diode (LED).

3. The oven of claim 1, wherein the light reflector is a polished stainless steel plate.

4. The oven of claim 3, wherein the polished stainless steel plate is rotatable, cylindrical, set inside the container, and the target is placed at the center thereof.

5. The oven of claim 2, wherein the laser diode (LD) is a 1200-Watt high-power laser diode bar.

6. The oven of claim 2, wherein the light-emitting diode (LED) is a 5-Watt high-power LED.

7. The oven of claim 2, wherein the LED is attached to a plate which is attached to the light reflector, and can move along the light reflector for changing the heating regions.

8. The oven of claim 1, which is used for heating food, chemical substances, and medicines.

* * * * *